US012410540B2

(12) United States Patent
Bian et al.

(10) Patent No.: US 12,410,540 B2
(45) Date of Patent: Sep. 9, 2025

(54) HIGH-VISCOSITY PTT POLYMERIZATION REACTOR AND METHOD FOR PREPARING DIRECT MELT-SPUN HIGH-VISCOSITY PTT/LOW-VISCOSITY PET TWO-COMPONENT ELASTIC FIBER

(71) Applicant: JIANGSU GANGHONG FIBER CO., LTD., Suzhou (CN)

(72) Inventors: Shuchang Bian, Suzhou (CN); Rui Wang, Suzhou (CN)

(73) Assignee: Jiangsu Ganghong Fiber Co., Ltd., Suzhou (CN)

( * ) Notice: Subject to any disclaimer, the term of this patent is extended or adjusted under 35 U.S.C. 154(b) by 0 days.

(21) Appl. No.: 18/970,382

(22) Filed: Dec. 5, 2024

(65) Prior Publication Data

US 2025/0230580 A1 Jul. 17, 2025

Related U.S. Application Data

(63) Continuation-in-part of application No. PCT/CN2024/093557, filed on May 16, 2024.

(30) Foreign Application Priority Data

Jan. 12, 2024 (CN) ..... 202410046155.2

(51) Int. Cl.
*D01D 5/38* (2006.01)
*D01F 8/14* (2006.01)

(52) U.S. Cl.
CPC ..... *D01D 5/38* (2013.01); *D01F 8/14* (2013.01); *D10B 2331/042* (2013.01); *D10B 2401/062* (2013.01); *D10B 2401/063* (2013.01)

(58) Field of Classification Search
USPC ..... 428/373; 442/362
See application file for complete search history.

(56) References Cited

U.S. PATENT DOCUMENTS 6,512,080 B2 * 1/2003 Kelsey ..... C08G 63/85 528/401
2003/0050429 A1 3/2003 Kato
2023/0026102 A1 * 1/2023 Fan ..... D02G 3/326

FOREIGN PATENT DOCUMENTS

CN 101126180 A 2/2008
CN 101851812 A 10/2010
(Continued)

OTHER PUBLICATIONS

Machine-generated English language translation of Description of CN 111701553A, 12 pages, retrieved from ESPACENET on May 14, 2025 (Year: 2020).*

*Primary Examiner* — Fred M Teskin
(74) *Attorney, Agent, or Firm* — Dinsmore & Shohl LLP

(57) ABSTRACT

The present disclosure relates to a high-viscosity PTT polymerization reactor and a method for preparing direct melt-spun high-viscosity PTT/low-viscosity PET two-component elastic fiber. A cage disc reactor combinations is designed in the low viscosity zone of the polymerization reactor, a circular channel is designed in the middle portion of the disc reactor combinations, and an agitating shaft is disposed in both the med-high viscosity zone and the high viscosity zone. The cage disc reactor combinations is designed with a material propelling part. The high-viscosity PTT production line comprises a first esterification reactor, a second esterification reactor, a first prepolymerization reactor, a second prepolymerization reactor, and a high-viscosity PTT polymerization reactor. The prepared elastic fiber can reach a fiber strength of 2.6~3.2 cN/dtex, a crimp shrinkage rate of 25%~75%, and a crimp stability of 82%~90%.

18 Claims, 4 Drawing Sheets

(56) References Cited

FOREIGN PATENT DOCUMENTS

| | | | | | |
|---|---|---|---|---|---|
| CN | 103801246 | A | | 5/2014 | |
| CN | 106337212 | A | | 1/2017 | |
| CN | 107964690 | A | | 4/2018 | |
| CN | 110270289 | A | | 9/2019 | |
| CN | 111101237 | A | | 5/2020 | |
| CN | 111560116 | A | | 8/2020 | |
| CN | 111701553 | A | * | 9/2020 | ..... B01J 19/0013 |
| CN | 112724390 | A | | 4/2021 | |
| CN | 115613159 | A | | 1/2023 | |
| CN | 117983153 | A | | 5/2024 | |
| DE | 10200230 | A1 | | 7/2003 | |
| WO | WO 01/58981 | A1 | * | 8/2001 | ..... C08G 63/78 |
| WO | WO 2021/128749 | A1 | * | 7/2021 | ..... D01D 5/08 |

* cited by examiner

HIGH-VISCOSITY PTT POLYMERIZATION REACTOR AND METHOD FOR PREPARING DIRECT MELT-SPUN HIGH-VISCOSITY PTT/LOW-VISCOSITY PET TWO-COMPONENT ELASTIC FIBER

CROSS-REFERENCE TO RELATED APPLICATIONS

This application is a Continuation-in-Part of PCT App. Serial No. PCT/CN2024/093557, having an International Filing Date of May 16, 2024, which claims the benefit of priority to Chinese Patent Application No. 202410046155.2 filed on Jan. 12, 2024, and the entire disclosure of both are hereby incorporated by reference.

TECHNICAL FIELD OF THE INVENTION

The present disclosure relates to a high-viscosity PTT polymerization reactor and a method for preparing direct melt-spun high-viscosity PTT/low-viscosity PET two-component elastic fiber.

BACKGROUND OF THE INVENTION

The application scope of elastic fibers in the modern chemical fiber industry is becoming increasingly wide, especially in recent years, with the rapid development of two-component elastic fiber theory, there has been a deeper understanding of the forming mechanism and elasticity generation mechanism of parallel two-component elastic fibers, and the variety of elastic fibers have also made significant progress compared to the original technology. At the beginning of the 1970s, DuPont first launched the single-component elastic fiber spandex, which quickly became popular in the market with its unique style and characteristics, and in the late 1970s, they also launched the parallel two-component elastic fiber T800, which uses PBT/PET parallel composite to produce good elastic effects, however, due to the low glass transition temperature of PBT components (26~42° C.), PBT/PET elastic fibers exhibit rapid crystallization characteristic under stress, and the T800 elastic fiber has poor elastic recovery rate and shape retention; entering the 21st century, with the successful industrialization of chemical and biological fermentation methods for PDO, PTT polyester has attracted attention for its unique molecular structure and excellent elastic recovery performance, DuPont T400, a PTT/PET two-component elastic fiber, has been launched, the PTT/PET two-component parallel composite fiber has excellent elastic recovery rate and shape retention, and will not deform after repeated stretching, its elastic slow-release effect overcomes the bound feeling of the elastic fiber spandex, and it has become the best elastic fiber variety in the fabric industry with its characteristics such as excellent resistance to chlorine bleaching and light exposure.

The development of two-component elastic fibers has become a key area of industry development in the past decade, the latest progress is to take advantage of the different orientation and crystallization behavior between PET polyester components with different viscosities, and during the spinning process, the high-viscosity component and the low-viscosity component exhibit elastic curls due to the different speed and percentage of transition from the orientation state to the crystalline state, forming a spring-like structure, thus exhibiting good elastic effect on the fabric. Patents CN111101237A, CN101126180A, CN106337212A, CN107964690A, CN101851812A, CN115613159A, etc., respectively disclose a series of parallel composite elastic fibers such as PET/PET, PBT/PET, PTT/PET and preparation methods thereof, and methods of preparing easily or deeply dyed elastic fibers using modified PET with elastic retention, such as high-viscosity ECDP, high-viscosity high-shrinkage polyester, high-viscosity polyester easily dyed by disperse dye, high-viscosity CDP cationic polyester, etc., and low-viscosity PET polyester.

The above-mentioned preparation methods of the elastic fibers are based on the production process of chip spinning of high-viscosity chips and low-viscosity chips respectively through pre-crystallization, melting of drying screw, to composite spinning and composite parallel spinneret forming, although the basic problems of parallel composite spinning technology are solved, chip spinning technology has obvious defects such as long process, high cost, low production capacity, and poor product quality stability.

Although PTT polyester raw materials are expensive, the outstanding crimp shrinkage rate, elastic recovery rate, and crimp stability of PTT/PET two-component elastic fibers make them the best product to replace higher priced elastic fibers such as spandex, PTT/PET fibers have the advantage of directly blending with fibers without coating, and PTT/PET two-component fibers have superior stress slow-release characteristics, which can gradually release external forces. Therefore, clothing woven from this fiber is more comfortable and considerate to wear. However, the crimp shrinkage rate, crimp stability, and quality stability of PTT/PET two-component fibers in the existing technology are not high enough.

SUMMARY OF THE INVENTION

A purpose of the present disclosure is to provide a high-viscosity PTT polymerization reactor for preparing a high-viscosity PTT melt, and the high-viscosity PTT melt prepared using the polymerization reactor has high viscosity, and can significantly improve the fiber properties when used for preparing a direct melt-spun high-viscosity PTT/low-viscosity PET two-component elastic fiber.

Another purpose of the present disclosure is to provide a direct melt-spun high-viscosity PTT/low-viscosity PET two-component elastic fiber, of which the crimp shrinkage rate, crimp stability, and quality stability are significantly improved.

Still another purpose of the present disclosure is to provide a method for preparing a direct melt-spun high-viscosity PTT/low-viscosity PET two-component elastic fiber, the preparation method has significantly reduced cost, high production capacity, and greatly shortened process, and the crimp shrinkage rate, crimp stability, and quality stability of the elastic fiber prepared by this method are significantly improved.

To achieve the above purpose, a technical solution employed by the present disclosure is:

A high-viscosity PTT polymerization reactor, is used to prepare a high-viscosity PTT melt for preparing a high-viscosity PTT/low-viscosity PET two-component elastic fiber, the high-viscosity PTT polymerization reactor is a horizontal polymerization reactor, and comprises a main body containing a chamber internally, the main body comprises a low viscosity zone, a med-high viscosity zone and a high viscosity zone disposed in sequence along the axial direction of the high-viscosity PTT polymerization reactor, the viscosity of the PTT melt in the low viscosity zone, the med-high viscosity zone and the high viscosity zone increases in sequence; the low viscosity zone and the med-high viscosity zone are both provided with disc reactors combinations, and the high viscosity zone is provided with a plurality of single-disc reactors; the high-viscosity PTT polymerization reactor further comprises a rotating shaft disposed in the front end of the low viscosity zone, a cage disc reactor combinations is designed in the low viscosity zone of the high-viscosity PTT polymerization reactor, and comprises a plurality of disc reactors combinations, and an outer cage frame fixedly connected to outer edges of the disc reactors combinations, and the rotating shaft drives the outer cage frame and the plurality of disc reactors combinations in the low viscosity zone to rotate; there is no agitating shaft disposed in an axial region corresponding to the disc reactors combinations in the low viscosity zone, and a circular channel is designed in the middle portion of the disc reactors combinations; there is an agitating shaft disposed in both the med-high viscosity zone and the high viscosity zone, and the disc reactors in the med-high viscosity zone and the high viscosity zone pass through the agitating shaft.

In the present disclosure, the design of a disc reactors combinations means that multiple adjacent disc reactors are fixedly connected, and rotate together with the agitating shaft or the outer cage frame.

In some implementations, the length of the low viscosity zone is half of the length of the high-viscosity PTT polymerization reactor, and the total length of the med-high viscosity zone and the high viscosity zone is half of the length of the high-viscosity PTT polymerization reactor.

In some implementations, the length of the agitating shaft disposed in the med-high viscosity zone and the high viscosity zone is half of the length of the high-viscosity PTT polymerization reactor.

In the present disclosure, half is not an exact value of half, but refer to a value roughly or around half, approximately equal to half.

In some implementations, the high-viscosity PTT polymerization reactor further comprises a prepolymer inlet located at the bottom of the front end of the low viscosity zone and a high-viscosity PTT melt outlet located at the bottom of the rear end of the high viscosity zone, wherein the high-viscosity PTT melt outlet is trumpet-shaped.

In some implementations, the outer cage frame comprises a cage shaped part with a gear shaped in front end, and a material propelling part extending along the axial direction of the high-viscosity PTT polymerization reactor from each gear bend of the cage shaped part, and the outer cage frame is fixedly connected to the rotating shaft.

In some implementations, the cross-section of the material propelling part is in a wedge shape, and the thick end of the wedge is oriented towards the direction of rotation of the disc reactors.

The outer cage frame of the present disclosure is a wedge structure, with the thick end of the wedge being oriented towards the direction of rotation of the disc reactors, which may enhance the mixing effect in the bottom material area, push more materials to higher positions along the rotation direction, increase the residence time of materials on the disc reactors, and improve the volatilization efficiency of the disc reactors.

The cage disc reactor combinations utilizes the pushing effect of the outer cage frame on the material, which may improve the devolatilization efficiency in the low viscosity zone in the front chamber bu up to 25%~40%, with the equal of the intrinsic viscosity at the inlet position of the med-high viscosity zone in the rear chamber, the length of the low viscosity zone in the front chamber may be shortened by 20%~35% compared to conventional disc reactors, the full volume of the polymerization reactor may be reduced by 18%~25%, the residence time of materials may be reduced by 18%~25%, the material may be mixed more uniformly, and the quality of the obtained high-viscosity PTT melt and the final fiber product may be effectively improved.

In some implementations, there are 8~12 material propelling parts. By providing 8~12 material propelling parts on the outer edges, the residence time of low-viscosity materials on the disc surface is significantly improved, effectively improving the devolatilization efficiency of the disc combinations in the front reactor and enhancing the degree of polymerization reaction in the front reactor, thereby reducing the residence time of materials; and the full volume of the high viscosity reactor is reduced by 20%~35%, and the length of the high viscosity reactor is greatly reduced, reaching 65%~80% of that of conventional PTT disc reactors for the same viscosity.

In some embodiments, a supporting seat may be fixedly disposed on the inner wall of the main body in the middle of the high-viscosity PTT polymerization reactor for supporting the agitating shaft. The front end of the agitating shaft disposed in the med-high viscosity zone and the high viscosity zone is fixed on the supporting seat.

In some implementations, the disc reactors in the med-high viscosity zone have a plurality of disc combinations, namely a 4-disc combination, a 3-disc combination and a 2-disc combination in sequence from front to rear; in the 2-disc combinations in the med-high viscosity zone, the distances between the disc combinations and between their two discs in each combination gradually increases from front to rear; the total number of disc reactors in the med-high viscosity zone and the high viscosity zone is 25~35; there are 8~12 single-disc reactors in the high viscosity zone, with the diameter of the disc reactors gradually decreasing from front to rear, and the diameter of the last disc reactor is 88%-92% of the diameter of the first disc reactor in the high viscosity zone; the high viscosity zone is further provided with a composite scraper, which comprises an axial scraper for scraping off the melt on the agitating shaft, a wall scraper for scraping off the melt on the inner wall of the high-viscosity PTT polymerization reactor, and a disc scraper for scraping off the melt on the disc reactors, the disc scraper being arranged in two layers and controlling the thickness of material on the disc reactors to not exceed 30 mm.

The first layer of disc scraper ensures effective separation of high-viscosity materials, while the second layer of disc scraper controls the thickness of material on the discs, which can effectively control the effective separation of high-viscosity melt after being scraped by the scraper, and control the material thickness on the two disc reactors to not exceed 30 mm, preferably 10-30 mm.

The high-viscosity PTT polymerization reactor of the present disclosure adopts a unique design, where the front chamber (low viscosity zone) adopts a cage disc reactor combinations, a circular channel is designed in the middle portion of the disc reactor combinations, and the cage disc reactor combinations utilizes the material propelling effect of the outer cage frame, which may improve the devolatilization efficiency of the front chamber by 25%~40%; the rear chamber (med-high viscosity zone and high viscosity zone) adopts a high-viscosity disc reactor design, and the rear end is designed with 8~12 single-discs and provided with an integrated scraper, comprising a disc scraper, a wall scraper and an axial scraper, wherein the upper disc scraper adopts a double-layer design, with the first layer of scraper scraping the melt off the disc surface and produces effective separation, and the second layer of scraper controlling the material thickness on the discs to be maintained at 10 to 30 mm; this can produce efficient volatilization effect.

The front chamber of the high-viscosity PTT polymerization reactor of the present disclosure utilizes the characteristics of a multi-stage disc combinations combined with a cage structure, where the outer edges of the disc combinations are designed with material propelling parts along the rotation direction, there is no central shaft in the front chamber, and by taking the 8~12 material propelling parts on the outer edges as the support structure, the disc area ratio may reach 45%~65%, which is higher than the disc area ratio of 30%~45% of ordinary disc reactors, and can maximize the spatial expansion of materials, to quickly complete the volatilization of reaction by-products; the circular channel is designed in the middle portion of the disc combinations, the volatile components may be more smoothly exported from the circular channel, and compared with the conventional disc design with a central shaft, the effective volatilization efficiency of the discs is increased by 30%~55%.

In some embodiments, the length-to-diameter ratio of the high-viscosity PTT polymerization reactor is (3.5~4.0):1.0, this high length-to-diameter ratio is beneficial for distributing more disc reactors to increase the effective devolatilization area, improve the vacuum degree of the reactor, and achieve the goal of increasing the viscosity of PTT melt and reducing the level of side reactions, and can also be combined with high vacuum design to quickly increase the viscosity of the high-viscosity PTT melt.

The present disclosure also provides a method for preparing a high-viscosity PTT/low-viscosity PET two-component elastic fiber using the aforementioned high-viscosity PTT polymerization reactor, the two-component elastic fiber contains a high-viscosity PTT component and a low-viscosity PET component, and the viscosity of the high-viscosity PTT component is greater than that of the low-viscosity PET component, and the preparation method comprises steps of preparing a high-viscosity PTT melt and a low-viscosity PET melt separately, and spinning the high-viscosity PTT melt and the low-viscosity PET melt through the same parallel composite spinning assembly to obtain the two-component elastic fiber; the viscosity of the high-viscosity PTT melt is greater than the viscosity of the low-viscosity PET melt; the step of preparing a high-viscosity PTT melt comprises sequentially passing terephthalic acid and 1,3-propanediol through a first esterification reactor and a second esterification reactor for esterification reactions, through a first prepolymerization reactor and a second prepolymerization reactor for prepolymerization reactions to give a PTT prepolymer, and polymerizing the PTT prepolymer in the aforementioned high-viscosity PTT polymerization reactor to obtain the high-viscosity PTT melt; the step of preparing low-viscosity PET melt comprises sequentially passing terephthalic acid and ethylene glycol through a first esterification reactor and a second esterification reactor for esterification reactions, through a first prepolymerization reactor and a second prepolymerization reactor for prepolymerization reactions to give a PET prepolymer, and polymerizing the PET prepolymer in a low-viscosity PET final polymerization reactor to obtain the low-viscosity PET melt.

In the present disclosure, PTT refers to poly(trimethylene terephthalate), and PET refers to polyethylene terephthalate.

The high-viscosity PTT/low-viscosity PET two-component elastic fiber of the present disclosure has two components namely a high-viscosity component and a low-viscosity component. The method for preparing a two-component elastic fiber is a melt direct spinning method, that is, directly using the polymerized melt for spinning, without going through the steps of cooling and chipping the melt, and then melting it for spinning.

In some implementations, in percent by weight, the two-component elastic fiber contains 35%-65% of high-viscosity PTT component and 65%-35% of low-viscosity PET component.

In some implementations, the high-viscosity PTT melt has an intrinsic viscosity of 0.92~1.16, and a dynamic viscosity of 320~1200 Pa·s (measured at 255° C.); the low-viscosity PET melt has an intrinsic viscosity of 0.45~0.55, and a dynamic viscosity of 90~240 Pa·s (measured at 275° C.).

In some implementations, the high-viscosity PTT melt has an intrinsic viscosity of 0.95~1.10, and a dynamic viscosity of 430~900 Pa·s (measured at 255° C.).

In some implementations, the high-viscosity PTT melt has an intrinsic viscosity of 0.97~1.05, and a dynamic viscosity of 500~750 Pa·s (measured at 255° C.).

In the present disclosure, the intrinsic viscosity is measured in a mixed solvent of phenol and tetrachloroethane in a volume ratio of 3:2.

In some implementations, in the same parallel composite spinning assembly, the high-viscosity PTT melt has a dynamic viscosity of 350~800 Pa·s, and the low-viscosity PET melt has a dynamic viscosity of 70~220 Pa·s. It can be seen that the high-viscosity PTT melt of the present disclosure has a relatively small viscosity drop after transported to the spinning assembly.

In some implementations, the preparation method controls the rotation rate of the rotating shaft in the low viscosity zone to be 0~5.5 rpm.

In some implementations, the preparation method controls the agitation rate of the agitating shaft in the med-high viscosity zone and the high viscosity zone to be 0~3.0 rpm.

In some implementations, the PTT prepolymer introduced into the high-viscosity PTT polymerization reactor has an intrinsic viscosity of 0.280~0.350. After the prepolymer melt of this viscosity enters the high-viscosity PTT polymerization reactor, it can effectively reduce the overall material load on the disc surface of the high-viscosity PTT polymerization reactor, obtain the optimal material residence time, and significantly reduce the side reaction level in the polymerization reactor, to minimize the amount of non-condensable gas produced.

In some implementations, the PTT prepolymer introduced into the high-viscosity PTT polymerization reactor has an intrinsic viscosity of 0.290~0.325.

In some implementations, the PTT prepolymer introduced into the high-viscosity PTT polymerization reactor has an intrinsic viscosity of 0.295~0.310.

In some implementations, when preparing the high-viscosity PTT melt, the preparation method further comprises a step of adding an esterification catalyst to the first esterification reactor before carrying out the esterification reaction, wherein the esterification catalyst is selected from tetrabutyl titanate and tetraisopropyl titanate.

In some implementations, the second esterification reactor used for preparing the high-viscosity PTT melt is a horizontal reactor and comprises three compartments arranged in sequence from front to rear, and when preparing the high-viscosity PTT melt, the preparation method further comprises a step of adding a catalyst blocking agent to the second compartment from front to rear of the second esterification reactor after the esterification reaction in the first compartment from front to rear of the second esterification reactor has completed, to deactivate the esterification catalyst, where the catalyst blocking agent is selected from trimethyl phosphate and phosphoric acid, and the mass of the catalyst blocking agent accounts for 15-30 ppm of the mass of the high-viscosity PTT melt.

After the esterification catalyst completes the catalysis of the esterification reaction, it has lost its catalytic effect on the polymerization reaction and is prone to increase side reactions in the polymerization reactor, therefore, a catalyst blocking agent is used to treat the esterification catalyst in the second compartment of the second esterification reactor. The esterification catalyst after blocking and deactivation treatment will not affect the subsequent polymerization reaction.

In some implementations, when preparing the high-viscosity PTT melt, the preparation method further comprises a step of adding a polymerization catalyst to the third compartment from front to rear of the second esterification reactor.

In some implementations, the polymerization catalyst is prepared by reacting a titanate with a protonic acid under anhydrous conditions, removing alcohol by-products, and dissolving the reaction system in 1,3-propanediol.

In some implementations, the titanate is selected from the group consisting of tetrabutyl titanate, tetraisopropyl titanate, and tetra(2-ethylhexyloxy) titanate.

In some implementations, the protonic acid is selected from the group consisting of formic acid, acetic acid, propionic acid, oxalic acid, malonic acid, succinic acid, citric acid, tripolyphosphoric acid, polyphosphoric acid, and combinations thereof.

In some implementations, the mass ratio of the titanate to the protonic acid is 1:(0.5-2.0). In some implementations, the mass percentage of titanium element in the polymerization catalyst is 1.0%-3.0%.

In some implementations, the mass of titanium element in the esterification catalyst accounts for 1~30 ppm of the mass of the high-viscosity PTT melt.

In some implementations, the mass of titanium element in the polymerization catalyst accounts for 30~100 ppm of the mass of the high-viscosity PTT melt.

In some implementations, the high-viscosity PTT polymerization reactor further comprises a steam feed inlet for introducing superheated 1,3-propanediol steam at the top of the main body located in the rear end portion of the low viscosity zone, the rear end portion of the med-high viscosity zone and the rear end portion of the high viscosity zone, and the preparation method further comprises steps of using a metering system to meter the superheated 1,3-propanediol steam and introducing it into the high-viscosity PTT polymerization reactor. By using this configuration, gel cross-linking carbonization can be formed at the upper portion of the rear end of the high-viscosity PTT polymerization reactor after the polymerization reactor runs for a period of time, the function of providing the 1,3-propanediol steam inlet is to facilitate regular cleaning on the basis of the whole polymerization device not stopping, so as to maintain the long-term operation capacity of the device.

Three superheated 1,3-propanediol steam feed inlets are disposed at the above three positions of the high-viscosity PTT polymerization reactor, provided with controllable flow devices, to provide sufficient superheated propanediol steam to the top of the reactors in the high viscosity zone, wet and timely depolymerize the oligomeric byproduct aggregates at the top of the reactors, facilitate timely cleaning of the deposited materials on the top of the polymerization reactor wall, and ensure long-term operation of the device.

In some implementations, when preparing the high-viscosity PTT melt, the preparation method further comprises a step of introducing a heat stabilizer and an antioxidant or a colorant into the second esterification reactor before the second esterification reaction; the heat stabilizer is selected from the group consisting of trimethyl phosphate, triethyl phosphate, triphenyl phosphate, triphenyl phosphite, triglycerol phosphate, and combinations thereof, the antioxidant is selected from the group consisting of Antioxidant 168, Antioxidant 1076, Antioxidant 1010, Antioxidant 1222, benzothiazole antioxidants, and combinations thereof.

In some implementations, the usage amount of the heat stabilizer or the antioxidant is 30~300 ppm of the total mass of the high-viscosity PTT melt.

To ensure the excellent anti-thermal degradation and anti-thermal oxidative degradation functions of the high-viscosity PTT melt during the transportation processes of esterification and polymerization melts, heat stabilizers and antioxidants are used for compounding, and to improve the stability of the high-viscosity PTT melt, the above additives can be added to respectively improve the thermal stability and antioxidant properties of the melt; the temperature in the polymerization reaction process of the high-viscosity PTT melt rises to a relatively high level, which generates thermal degradation and thermal oxidative degradation, producing acrolein and allyl alcohol, and leading to accelerated degradation, and during the spinning process, a large amount of acrolein and allyl alcohol is released, which stimulates the eyes and respiratory tract of operators and can cause liver damage under long time exposure. To control the side reaction level in polymerization under high temperature conditions, the above-mentioned heat stabilizers and antioxidants are added, and antioxidants are added to further reduce the thermal degradation caused by trace oxygen during the melt transport processes, greatly improve the stability and anti-degradation ability of the melt, and prevent problems caused by catalyst deposition in pipelines and the box.

Heat stabilizers and antioxidants are beneficial for reducing the viscosity drop level during the melt transport processes, for the high-viscosity PTT melt transport, the residence time in the pipeline is within 30~40 min, and the viscosity drop of the high-viscosity PTT melt is effectively controlled between 0.018 and 0.045, a more optimized viscosity drop level is between 0.015 and 0.055, and when combined with the design of short process melt transport, the optimal viscosity drop is between 0.018 and 0.030, compared with the existing viscosity drop of 0.120 to 0.140 for the high-viscosity PTT polyester with an increased viscosity, it can significantly reduce the original intrinsic viscosity of the melt and effectively improve product quality. At the same time, the melt spinning process does not produce irritating odors such as acrolein and allyl alcohol.

In some implementations, the high-viscosity PTT polymerization reactor is connected to a vacuum pump, and the ultimate vacuum degree of the vacuum pump is 60~75 Pa, and the preparation method controls the pumping rate of the vacuum pump to be 70~220 kg/h; the vacuum degree in the high-viscosity PTT polymerization reactor is controlled to 90~140 Pa during operation. This configuration can meet the production capacity of 30,000 to 100,000 tons/year of high-viscosity PTT polyester melt. According to experimental research, the volatile matter generation of the high-viscosity (intrinsic viscosity of 1.05~1.16) PTT polymerization reactor is 1.5~2.2 times that of conventional-viscosity (intrinsic viscosity of 0.92) PTT polymerization devices, and the higher the viscosity at the high viscosity outlet, the higher the amount of non-condensable gas produced, therefore, the pumping design of the vacuum pump is 1.5~2.5 times that of conventional polymerization devices with the same production capacity, and according to the production capacity of 30,000~100,000 tons/year, the pumping capacity of the vacuum pump is selected in the range of 70~220 kg/h. The design of the vacuum system for the devices considers the hazards of acrolein and allyl alcohol, and adopts a fully enclosed design, and a neutralization device is designed for wastewater and exhaust gas, which is then sent to a stripping column for treatment, to meet emission standards.

In some implementations, melt pumps are used to transport the high-viscosity PTT melt and the low-viscosity PET melt, and melt coolers are disposed at outlets of the melt pumps; the preparation method controls the temperature of the high-viscosity PTT melt after being cooled by the melt cooler to be between 254 and 256° C.; filters and booster pumps are disposed between the melt pumps and the parallel composite spinning assembly; the preparation method controls the transport time of the high-viscosity PTT melt to be 30~40 min.

In some implementations, the first esterification reactor and the second esterification reactor used for preparing the high-viscosity PTT melt are both provided with distillation columns at their upper ends, and the preparation method further comprises a step of extracting and recovering 1,3-propanediol from kettles of the distillation columns. The recovery may be carried out using a special recovery device. After the recovery, the impurities in 1,3-propanediol are removed to refine, the refined 1,3-propanediol may be re-added to the raw material pulping system for subsequent esterification and polymerization.

Preferably, the distillation column at the upper end of the second esterification reactor is disposed in the third compartment from front to rear of the second esterification reactor.

In some implementations, the low-viscosity PET final polymerization reactor is a horizontal polymerization reactor, and the length-to-diameter ratio thereof is (2.2~2.8):1.0.

In some implementations, the preparation method further comprises a step of introducing a viscosity reducer into the high-viscosity PTT melt before the high-viscosity PTT melt passes through a filter; the viscosity reducer is selected from the group consisting of poly(ethylene terephthalateco-1,4-cyclohexanedimethylene terephthalate) (PETG), cationic dyeable polyester (CDP), easy cationic dyeable polyester (ECDP), atmospheric pressure boiling dyeing polyester EDDP, polybutylene terephthalate (PBT), and poly(trimethylene terephthalate) (PTT), and combinations thereof.

Further, the usage amount of the viscosity reducer is 0.2% to 3.0%, preferably 0.5% to 2.0%, and more preferably 0.8% to 1.5% of the total mass of the melt, the addition of the viscosity reducer can significantly reduce the kinematic viscosity of the high-viscosity melt, improve the efficiency of melt transport, and reduce the degradation in the process.

In some implementations, when preparing the high-viscosity PTT melt, the molar ratio of terephthalic acid to 1,3-propanediol is 1:(1.05~1.65).

In some implementations, the esterification reaction in the first esterification reactor used for preparing the high-viscosity PTT melt is carried out at 250° C.~252° C.

In some implementations, the esterification reaction in the first esterification reactor used for preparing the high-viscosity PTT melt is carried out at a pressure of 0.7~1.8 kgf/cm$^2$.

In some implementations, the esterification reaction in the second esterification reactor used for preparing the high-viscosity PTT melt is carried out at 250° C.~252° C.

In some implementations, the esterification reaction in the second esterification reactor used for preparing the high-viscosity PTT melt is carried out at atmospheric pressure.

In some implementations, the same spinning assembly is a composite spinning box.

In some implementations, the composite spinning box comprises a composite spinneret.

The present disclosure further provides a high-viscosity PTT/low-viscosity PET two-component elastic fiber prepared by the above-mentioned preparation method.

In some implementations, the two-component elastic fiber has a strength of 2.6~3.2 cN/dtex, a crimp shrinkage rate of 25%~75%, and a crimp stability of 82%~90%.

Due to the use of the above technical solutions, the present disclosure has the following advantages over the prior art:

The high-viscosity PTT polymerization reactor of the present disclosure adopts an unconventional disc reactor design, where the front chamber (the low viscosity zone) adopts an out cage frame-disc combinations design; the rear chamber (the med-high viscosity zone and the high viscosity zone) adopts the disc combinations combined with the single-disc, as well as a composite scraper design, which may greatly increase the viscosity of the high-viscosity PTT melt, effectively reduce the side reaction level during the polymerization of the high-viscosity PTT, and ultimately achieve significant improvements in various properties of the two-component elastic fiber.

The present disclosure utilizes two different polyester production lines to produce a high-viscosity PTT polyester and a low-viscosity PET polyester, respectively, the two melts of different viscosities are then transported to the same parallel composite spinning assembly through melt transport, after which the high-viscosity PTT/low-viscosity PET two-component elastic fiber is prepared, achieving the preparation of direct melt-spun high-viscosity PTT/low-viscosity PET parallel elastic fiber.

In the present disclosure, a special polymerization catalyst is used, which is prepared by reacting a titanate with a protonic acid under anhydrous conditions, removing alcohol by-products, and dissolving in 1,3-propanediol, the polymerization catalyst does not contain Ti—OH groups and can significantly inhibit the hydrolysis of ordinary titanium-based catalysts during the polymerization stage, thereby significantly inhibiting the occurrence of side reactions during the polymerization stage, which is beneficial for improving the properties of the high-viscosity PTT melt and the properties of the final two-component elastic fiber.

In the present disclosure, the intrinsic viscosity of the high-viscosity PTT melt may reach 0.92~1.16, the intrinsic viscosity of the low-viscosity PET melt is 0.45~0.55, and the viscosity of this high-viscosity PTT melt is much higher than that of the prior art.

The two-component elastic fiber of the present disclosure has a strength of 2.6~3.2 cN/dtex, a crimp shrinkage rate of 25%~75%, and a crimp stability of 82%~90%, which are much higher than the levels of existing two-component elastic fibers. The two-component elastic fiber of the present disclosure can be various varieties such as FDY, POY, DTY, etc.

The industrial production of two-component elastic fibers using the preparation method of the present disclosure may achieve a production capacity of low-viscosity PET melt of 30,000~100,000 tons/year and a production capacity of high-viscosity PTT melt of 30,000 to 80,000 tons/year, and when the product is the high-viscosity PTT/low-viscosity PET direct melt-spun two-component elastic fiber, the overall production capacity of the device is 60,000 to 160,000 tons/year.

Wherein, 1—low viscosity zone, 2—med-high viscosity zone, 3—high viscosity zone, 4—composite scraper, 5—disc scraper, 6—axial scraper, 7—wall scraper, 8—agitating shaft, 9—disc reactor, 10—first esterification reactor, 11—second esterification reactor, 12—first prepolymerization reactor, 13—second prepolymerization reactor, 14—high-viscosity PTT polymerization reactor, 15—low-viscosity PET final polymerization reactor, 16—melt pump, 17—prepolymer inlet, 18—high-viscosity PTT melt outlet, 19—outer cage frame, 20—rotating shaft, 21—cage shaped part, 22—material propelling part, 23—supporting seat.

DETAILED DESCRIPTION OF EXEMPLARY EMBODIMENTS

The present disclosure is further explained in detail below in combination with specific embodiments; it should be understood that, those embodiments are to explain the basic principle, major features and advantages of the present disclosure, and the present disclosure is not limited by the scope of the following embodiments; the implementation conditions employed by the embodiments may be further adjusted according to particular requirements, and undefined implementation conditions usually are conditions in conventional experiments. In the following embodiments, unless otherwise specified, all raw materials are basically commercially available or prepared by conventional methods in the field.

The embodiments described above are only for illustrating the technical concepts and features of the present disclosure, and are intended to make a person familiar with the technology being able to understand the content of the present disclosure and thereby implement it, and should not limit the protective scope of this disclosure. Any equivalent variations or modifications according to the spirit of the present disclosure should be covered by the protective scope of the present disclosure.

The present disclosure will be further described in conjunction with the accompanying drawings and preferred embodiments of the present disclosure. In the following embodiments, it should be noted that terms such as orientations "front" and "rear" are based on the flow direction of the materials, with the directions in which the material flows first being the front and the direction in which it flows later being the rear. For example, in FIG. 1, the term "front" refers to the left side of FIG. 1, and the term "rear" refers to the right side of FIG. 1, therefore, the orientation and positional relationship described in the present disclosure are only for the convenience of describing the disclosure and simplifying the description, and do not indicate or imply that the device or element referred to must have a specific orientation, only have a specific orientation, be constructed and operated in a specific orientation, and therefore cannot be understood as a limitation of the present disclosure.

Figure 1:
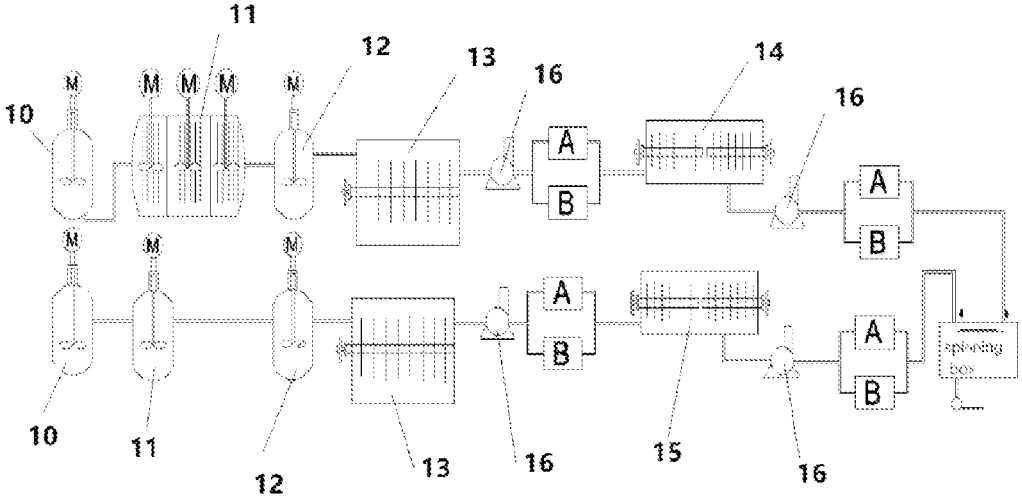
FIG. 1 is a schematic diagram of a polymerization system with two production lines used in an embodiment of the present disclosure.
Figure 2:
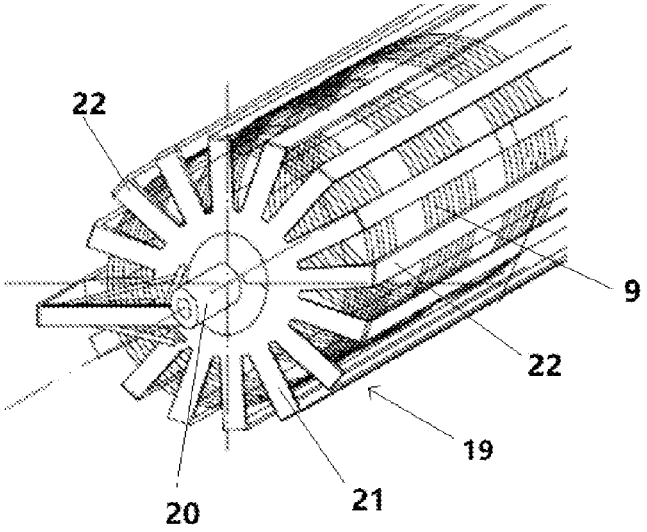
FIG. 2 is a schematic inner structure diagram of a high-viscosity PTT polymerization reactor used in an embodiment of the present disclosure.
Figure 3:
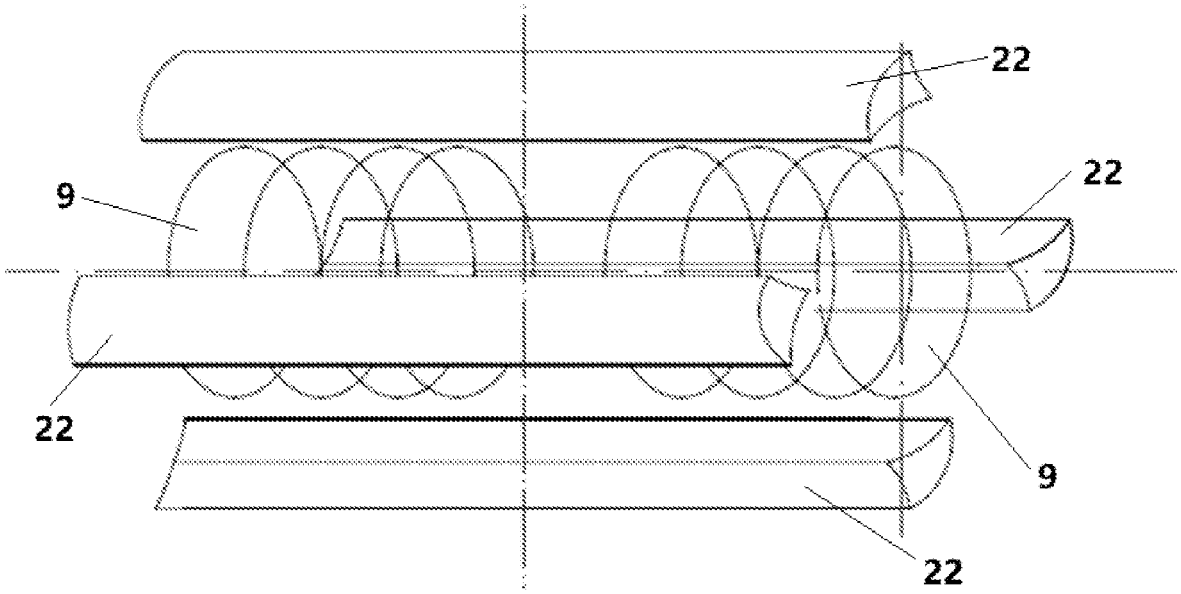
FIG. 3 is a schematic diagram of disc reactors and a material propelling part of the high-viscosity PTT polymerization reactor used in an embodiment of the present disclosure.
Figure 4:
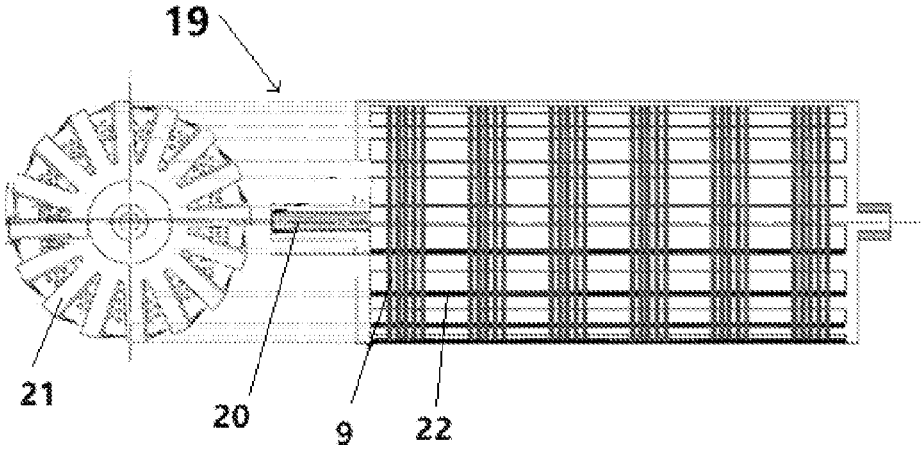
FIG. 4 is another schematic inner structure diagram of the high-viscosity PTT polymerization reactor used in an embodiment of the present disclosure.
Figure 5:
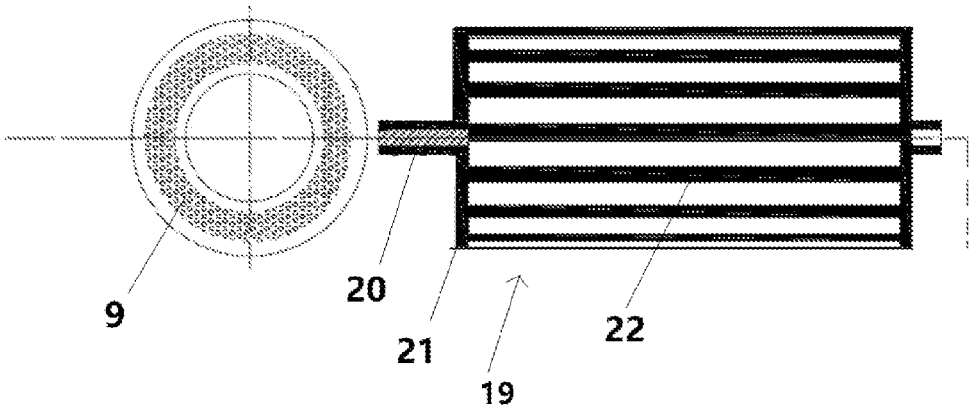
FIG. 5 is a schematic structure diagram of the disc reactors and an outer cage frame of the high-viscosity PTT polymerization reactor used in an embodiment of the present disclosure.

As shown in FIG. 1, the preparation of a high-viscosity PTT/low-viscosity PET two-component elastic fiber in an embodiment uses two production lines. The first production line prepares the high-viscosity PTT melt, as shown in the first row of FIG. 1, and this production line comprises a five-reactor system consisting of a first esterification reactor 10, a second esterification reactor 11, a first prepolymerization reactor 12, a second prepolymerization reactor 13, and a high-viscosity PTT polymerization reactor 14. The five reactors are in communication through necessary pipelines, and necessary vacuum systems and the like are in communication with the five reactors. Wherein, a melt pump 16 and filters A and B are provided between the second prepolymerization reactor 13 and the high-viscosity PTT polymerization reactor 14, and in the actual production process, the filters A and B are not turned on at the same time, for example, the filter A may be turned on first, and after the device runs for a period of time, the filter B can be switched to use, at this time, the filter A can be cleaned.

The second production line prepares the low-viscosity PET melt, as shown in the second row of FIG. 1, and this production line comprises another five-reactor system consisting of a first esterification reactor 10, a second esterification reactor 11, a first prepolymerization reactor 12, a second prepolymerization reactor 13, and a low-viscosity PET final polymerization reactor 15. The five reactors are in communication through necessary pipelines, and necessary vacuum systems and the like are in communication with the five reactors. Wherein, a melt pump 16 and filters A and B are provided between the second prepolymerization reactor 13 and the low-viscosity PET final polymerization reactor 15, and in the actual production process, the filters A and B are not turned on at the same time, for example, the filter A may be turned on first, and after the device runs for a period of time, the filter B can be switched to use, at this time, the filter A can be cleaned.

Figure 6:
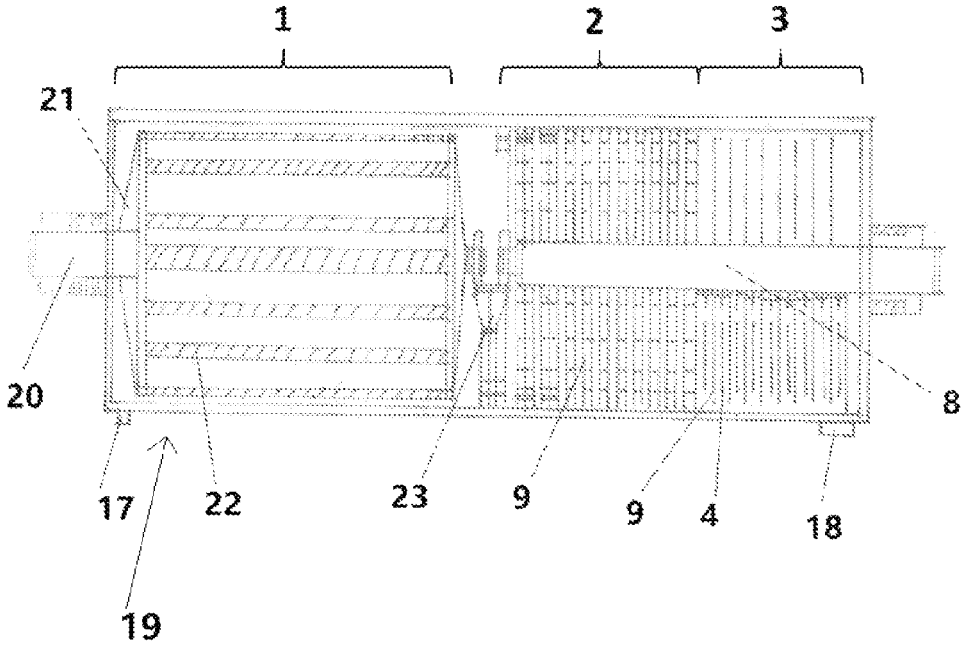
FIG. 6 is a schematic structure diagram of a high-viscosity PTT polymerization reactor used in an embodiment of the present disclosure.

For the high-viscosity PTT polymerization reactor 14, as shown in FIG. 6, it is a horizontal polymerization reactor, and comprises a main body containing a chamber internally, the main body comprises a low viscosity zone 1, a med-high viscosity zone 2 and a high viscosity zone 3 disposed in sequence along the axial direction of the high-viscosity PTT polymerization reactor, the viscosity of the PTT melt in the low viscosity zone 1, the med-high viscosity zone 2 and the high viscosity zone 3 increases in sequence; the low viscosity zone 1 and the med-high viscosity zone 2 are both provided with disc reactors 9 combinations, and the high viscosity zone 3 is provided with a plurality of single disc reactors 9.

As shown in FIGS. 2-6, the high-viscosity PTT polymerization reactor 14 further comprises a rotating shaft 20 disposed in the front end of the low viscosity zone 1, a cage disc reactor combinations is designed in the low viscosity zone 1 of the high-viscosity PTT polymerization reactor 14, and comprises a plurality of disc reactors 9 combinations, and an outer cage frame 19 fixedly connected to outer edges of the disc reactors 9 combinations, and the rotating shaft 20 drives the outer cage frame 19 and the plurality of disc reactors 9 combinations in the low viscosity zone 1 to rotate; there is no agitating shaft disposed in an axial region corresponding to the disc reactors 9 combinations in the low viscosity zone 1, and a circular channel is designed in the middle portion of the disc reactors 9 combinations; there is an agitating shaft 8 disposed in both the med-high viscosity zone 2 and the high viscosity zone 3, and the disc reactors 9 in the med-high viscosity zone 2 and the high viscosity zone 3 pass through the agitating shaft 8.

The length of the low viscosity zone 1 is half of the length of the high-viscosity PTT polymerization reactor 14, and the total length of the med-high viscosity zone 2 and the high viscosity zone 3 is half of the length of the high-viscosity PTT polymerization reactor 14. The length of the agitating shaft 8 disposed in the med-high viscosity zone 2 and the high viscosity zone 3 is half of the length of the high-viscosity PTT polymerization reactor 14. It should be emphasized that half in the present disclosure is not an exact value of half, but refer to a value roughly or around half, approximately equal to half.

The high-viscosity PTT polymerization reactor 14 further comprises a prepolymer inlet 17 located at the bottom of the front end of the low viscosity zone 1 and a high-viscosity PTT melt outlet 18 located at the bottom of the rear end of the high viscosity zone 3, wherein the high-viscosity PTT melt outlet 18 is trumpet-shaped.

As shown in FIGS. 2-5, the outer cage frame 19 comprises a cage shaped part 21 with a gear shaped in front end, and a material propelling part 22 extending along the axial direction of the high-viscosity PTT polymerization reactor 14 from each gear bend of the cage shaped part 21, and the outer cage frame 19 is fixedly connected to the rotating shaft 20. The cross-section of the material propelling part 22 is in a wedge shape, and the thick end of the wedge is oriented towards the direction of rotation of the disc reactors 9. There are 8~12 material propelling parts 22.

The disc reactors 9 in the med-high viscosity zone 2 have a plurality of disc combinations designs, namely a 4-disc combination, a 3-disc combination and a 2-disc combination in sequence from front to rear; in the 2-disc combinations design in the med-high viscosity zone 2, the distances between the disc combinations and between their two discs in each combination gradually increases from front to rear; the total number of disc reactors 9 in the med-high viscosity zone 2 and the high viscosity zone 3 is 25~35; there are 8~12 single-disc reactors 9 in the high viscosity zone, with the diameter of the disc reactors 9 gradually decreasing from front to rear, and the diameter of the last disc reactor 9 is 88%-92% of the diameter of the first disc reactor 9 in the high viscosity zone 3.

Figure 7:
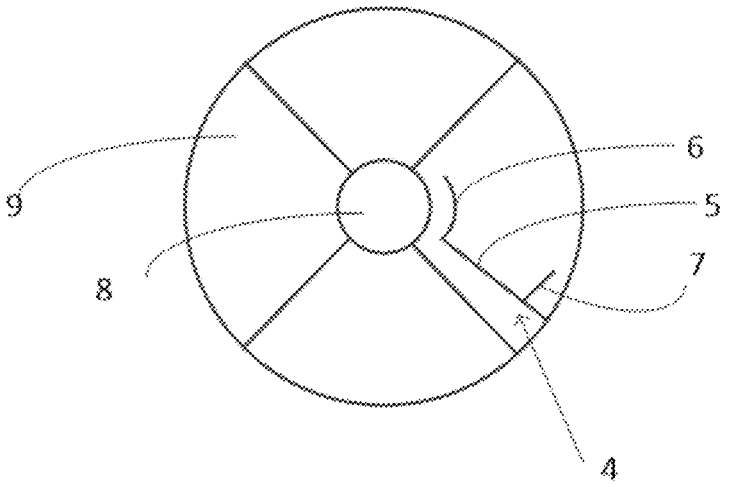
FIG. 7 is a schematic structure diagram of a composite scraper in the high viscosity zone in the high-viscosity PTT polymerization reactor used in an embodiment of the present disclosure.

As shown in FIG. 7, the high viscosity zone 3 is further provided with a composite scraper 4, the composite scraper 4 comprises an axial scraper 6 for scraping off the melt on the agitating shaft, a wall scraper 7 for scraping off the melt on the inner wall of the high-viscosity polymerization reactor 14, and a disc scraper 5 for scraping off the melt on the disc reactors 9, the disc scraper 5 is arranged in two layers and controls the thickness of the material on the disc reactors 9 to not exceed 30 mm.

As shown in FIG. 6, the length-to-diameter ratio of the high-viscosity PTT polymerization reactor 14 is (3.5~4.0): 1.0.

As shown in FIG. 1, the second esterification reactor 11 used for preparing the high-viscosity PTT melt is a horizontal reactor, and comprises three compartments arranged in sequence from front to rear. The first esterification reactor 10 and the second esterification reactor 11 used for preparing the high-viscosity PTT melt are both provided with distillation columns at their upper ends. The distillation column at the upper end of the second esterification reactor 11 is disposed in the third compartment from front to rear of the second esterification reactor 11.

The high-viscosity PTT polymerization reactor 14 further comprises a steam feed inlet for introducing superheated 1,3-propanediol steam at the top of the main body located in the rear end portion of the low viscosity zone 1, the rear end portion of the med-high viscosity zone 2 and the rear end portion of the high viscosity zone 3. The high-viscosity PTT polymerization reactor is connected to a vacuum pump, and the ultimate vacuum degree of the vacuum pump is 60~75 Pa, the pumping rate of the vacuum pump is 70~220 kg/h, and the vacuum degree in the high-viscosity PTT polymerization reactor 14 is 90~140 Pa.

The high-viscosity PTT polymerization reactor 14 is connected to a vacuum pump, and the vacuum pump is a liquid ring pump, with its inlet being provided with a chilled water device for cooling the gas. The melt pumps transport the high-viscosity PTT melt and the low-viscosity PET melt, with their outlets being provided with melt coolers.

A dynamic mixer and a filter are arranged downstream of the high-viscosity PTT polymerization reactor 14 and the low-viscosity PET final polymerization reactor 15 and upstream of the same spinning assembly; a viscosity reducer injection system is arranged upstream of the dynamic mixer.

Necessary melt pumps, vacuum pumps, and conveying pipeline, etc. may be provided on the pipelines connecting the five reactors of the two production lines.

The same spinning assembly is a composite spinning box, and the high-viscosity PTT polymerization reactor 14 is arranged at the top of the composite spinning box to shorten the conveying distance of the melt, especially the high-viscosity PTT melt. The composite spinning box comprises a spinneret.

Embodiment 1

This embodiment provided a method for preparing a high-viscosity PTT/low-viscosity PET two-component elastic fiber, which comprises specific steps of:

The method for preparing a polymerization catalyst used in this embodiment was as follows:

Tetrabutyl titanate was mixed with acetic acid to carry out an exothermic reaction, with a mass ratio of 1:1, after the reaction, a titanium tetraacetate complex and a large amount of n-butanol byproduct were generated, the reaction system was vacuum purified at 50° C. for 2.0 hours to remove the generated n-butanol, and cooled to room temperature, 1,3-propanediol was injected into the reaction system under agitating to prepare a 1,3-propanediol solution of the polymerization catalyst, the injection amount of 1,3-propanediol was controlled so that the content of titanium element in the polymerization catalyst solution was 1.0%.

A polymerization device using the two production lines mentioned above was used to synthesize the high-viscosity PTT melt and the low-viscosity PET melt, respectively.

For the high-viscosity PTT melt production line, the device comprises a pulping reactor, a first esterification reactor (with a distillation column at its upper end), a second esterification reactor (with a three-chamber structure, and a distillation column at its upper end), a first prepolymerization reactor, a second prepolymerization reactor, a high-viscosity PTT polymerization reactor, and supporting vacuum systems and melt transport systems.

For the low-viscosity PET melt production line, the device comprises a pulping reactor, a first esterification reactor, a second esterification reactor, a first prepolymerization reactor, a second prepolymerization reactor, a low-viscosity PET final polymerization reactor, and supporting vacuum systems and melt transport systems.

Synthesis of High-Viscosity PTT Melt:

Purified terephthalic acid and 1,3-propanediol were sequentially subjected to esterification reactions in the first esterification reactor and the second esterification reactor, and prepolymerization reactions in the first prepolymerization reactor and the second prepolymerization reactor to give a PTT prepolymer, which was polymerized in the high-viscosity PTT polymerization reactor to give a high-viscosity PTT melt. The molar ratio of purified terephthalic acid to 1,3-propanediol was 1:1.25. The esterification temperature in the first esterification reactor was 250° C.~252° C., and the esterification was carried out at a pressure of 0.7~0.8 kgf/cm$^2$ (this pressure refers to the actual pressure in the first esterification reactor, which is lower than atmospheric pressure, that is, the reaction the first esterification reactor is in fact carried out under reduced pressure). The esterification temperature in the second esterification reactor was 250° C.~252° C., and the esterification was carried out under normal pressure. An esterification catalyst tetrabutyl titanate was added to the first esterification reactor, with a usage amount such that the mass of titanium element was 30 ppm of the mass of the melt. A blocking agent for the esterification catalyst, trimethyl phosphate, is introduced into the second compartment from front to rear of the second esterification reactor, with a mass of 100 ppm of the total mass of the high-viscosity PTT melt, to deactivate the esterification catalyst. The polymerization catalyst prepared above was introduced into the third compartment from front to rear of the second esterification reactor, with a usage amount such that the mass of titanium element was 70 ppm of the mass of the melt. Before the second esterification reaction in the second esterification reactor is carried out, an ordinary titanium dioxide matting agent color paste (prepared by grinding and dispersing titanium dioxide and ethylene glycol, with titanium dioxide accounting for 10 wt % and ethylene glycol accounting for 90 wt %) is added into the second esterification reactor through corresponding pipelines, its usage amount is such that titanium dioxide accounts for 0.32% of the total mass of the melt. The reaction temperature in the first prepolymerization reactor was 250° C., and the vacuum degree was 9.9 kPa; the reaction temperature in the second prepolymerization reactor was 251° C., and the vacuum degree was 1.15 kPa; the temperature at the melt outlet of the high-viscosity PTT polymerization reactor was 252.6° C., and the vacuum degree in the high-viscosity PTT polymerization reactor was 138 Pa. And the steam feed inlet of the high-viscosity PTT polymerization reactor is sprayed with superheated 1,3-propanediol through a steam jet pump, and for the large amount of cyclic dimers generated during the polymerization process, a double polycondensation circulating cooling system is provided to facilitate the cleaning of the vacuum system. The high-viscosity PTT melt discharged ultimately from the melt outlet of the high-viscosity PTT polymerization reactor had an intrinsic viscosity of 0.922, and a dynamic viscosity of 375 Pa·s, where the intrinsic viscosity was determined in a mixed solvent of phenol and tetrachloroethane in a volume ratio of 3:2. The dynamic viscosity was measured at 252° C.

Synthesis of Low-Viscosity PET Melt:

Purified terephthalic acid and ethylene glycol were sequentially subjected to esterification reactions in the first esterification reactor and the second esterification reactor, and prepolymerization reactions in the first prepolymerization reactor and the second prepolymerization reactor to give a PET prepolymer, which was polymerized in the low-viscosity PET final polymerization reactor to give a low-viscosity PET melt. Both the catalysts for esterification and polymerization were ethylene glycol antimony, and its usage amount was such that the mass of antimony element in it was 210 ppm of the total mass of the PET melt, and this catalyst was added to the reaction system in the first esterification reactor. The first esterification reactor was for esterification under pressurization, and the second esterification reactor was for esterification at atmospheric pressure. Before the second esterification reaction in the second esterification reactor is carried out, an ordinary titanium dioxide matting agent color paste (prepared by grinding and dispersing titanium dioxide and ethylene glycol, with titanium dioxide accounting for 10 wt % and ethylene glycol accounting for 90 wt %) is added into the second esterification reactor through corresponding pipelines, its usage amount is such that titanium dioxide accounts for 0.30% of the total mass of the melt. By adjusting the reaction conditions (including the vacuum degree of the low-viscosity PET final polymerization reactor, the agitating rate of the low-viscosity PET final polymerization reactor, the polymerization temperature of the low-viscosity PET final polymerization reactor, etc., the vacuum degree was controlled at 180~200 Pa, the agitating rate was 2.2~2.5 rpm in the med-high viscosity zone and high viscosity zone; the polymerization temperature ranged from 272 to 273° C.), the resulting low-viscosity PET melt had an intrinsic viscosity of 0.452, and a dynamic viscosity of 90 Pa·s. The intrinsic viscosity was measured in a mixed solvent of phenol and tetrachloroethane in a volume ratio of 3:2. The dynamic viscosity was measured at 270° C.

Spinning:

Finally, the high-viscosity PTT melt and the low-viscosity PET melt were transported through the melt transport in a mass ratio of 5:5 to the composite spinning box, and then spun through the composite spinning spinneret to obtain a high-viscosity PTT/low-viscosity PET two-component elastic fiber.

Wherein, the parameters of reaction conditions, high-viscosity PTT melt, and low-viscosity PET melt are shown in Tables 1-5. Wherein, '-' indicates none. The melt chip performance was tested using GB/T 14190-2017 standard, where the intrinsic viscosity was measured in a mixed solvent of phenol and tetrachloroethylene in a volume ratio of 3:2; moisture, ash content, ferrum content, and agglomerated particles refer to the content of water, ash, Fe element, and agglomerated particles in the polyester in mass fraction, respectively.

Embodiments 2-13

Embodiments 2-13 provided methods for preparing a high-viscosity PTT/low-viscosity PET two-component elastic fiber, where the specific steps were basically the same as in Embodiment 1, by differing in that when synthesizing the high-viscosity PTT melt, the parameters of the high-viscosity PTT melt were adjusted by adjusting the reaction conditions (including the vacuum degree of the high-viscosity PTT polymerization reactor, the agitating rate in the low viscosity zone, the agitating rate in the med-high viscosity zone and the high viscosity zone, the inlet temperature of the PTT prepolymer melt (PTT low-viscosity melt), and the residence time of material in the polymerization reactor, etc.); when synthesizing the low-viscosity PET melt, the parameters of the low-viscosity PET melt were adjusted by adjusting the reaction conditions (including the vacuum degree of the low-viscosity PET final polymerization reactor, the agitating rate in the low-viscosity PET final polymerization reactor, and the polymerization temperature in the low-viscosity PET final polymerization reactor). Wherein, the parameters of reaction conditions, high-viscosity PTT melt, and low-viscosity PET melt are shown in Tables 1-5.

Embodiment 14

Embodiment 14 provided A method for preparing a high-viscosity PTT/low-viscosity PET two-component elastic fiber, where the specific steps were basically the same as in Embodiment 1, by differing in that when synthesizing the high-viscosity PTT melt, the parameters of the high-viscosity PTT melt were adjusted by adjusting the reaction conditions (including the vacuum degree of the high-viscosity PTT polymerization reactor, the agitating rate in the low viscosity zone, the agitating rate in the med-high viscosity zone and the high viscosity zone, the inlet temperature of the PTT prepolymer melt (PTT low-viscosity melt), and the residence time of material in the polymerization reactor, etc.); when synthesizing the low-viscosity PET melt, the parameters of the low-viscosity PET melt were adjusted by adjusting the reaction conditions (including the vacuum degree of the low-viscosity PET final polymerization reactor, the agitating rate in the low-viscosity PET final polymerization reactor, and the polymerization temperature in the low-viscosity PET final polymerization reactor). In addition, a viscosity reducer was injected into the system, specifically an amorphous polyester with an intrinsic viscosity of 0.55 (measured using phenol:tetrachloroethylene (in a volume ratio of 3:2)), with a usage amount of 0.5% of the total mass of the melt. Wherein, the parameters of reaction conditions, high-viscosity PTT melt, and low-viscosity PET melt are shown in Tables 1-5.

Embodiment 15

Embodiment 15 provided A method for preparing a high-viscosity PTT/low-viscosity PET two-component elastic fiber, where the specific steps were basically the same as in Embodiment 1, by differing in that when synthesizing the high-viscosity PTT melt, the parameters of the high-viscosity PTT melt were adjusted by adjusting the reaction conditions (including the vacuum degree of the high-viscosity PTT polymerization reactor, the agitating rate in the low viscosity zone, the agitating rate in the med-high viscosity zone and the high viscosity zone, the inlet temperature of the PTT prepolymer melt (PTT low-viscosity melt), and the residence time of material in the polymerization reactor, etc.); when synthesizing the low-viscosity PET melt, the parameters of the low-viscosity PET melt were adjusted by adjusting the reaction conditions (including the vacuum degree of the low-viscosity PET final polymerization reactor, the agitating rate in the low-viscosity PET final polymerization reactor, and the polymerization temperature in the low-viscosity PET final polymerization reactor). In addition, a viscosity reducer was injected into the system, specifically an amorphous polyester with an intrinsic viscosity of 0.58 (measured using phenol:tetrachloroethylene (in a volume ratio of 3:2)), with a usage amount of 0.8% of the total mass of the melt. Wherein, the parameters of reaction conditions, high-viscosity PTT melt, and low-viscosity PET melt are shown in Tables 1-5.

Comparative Example 1

This comparative example 1 provided a method for preparing a direct melt-spun high-viscosity PET/low-viscosity PET two-component elastic fiber. This preparation method adopted a six-reactor system consisting of a first esterification reactor, a second esterification reactor, a first prepolymerization reactor and a second prepolymerization reactor connected successively, and a high viscosity final polymerization reactor and a low viscosity final polymerization reactor respectively connected to the second prepolymerization reactor. The high-viscosity PET melt obtained in the high viscosity final polymerization reactor and the low-viscosity PET obtained in the low viscosity final polymerization reactor were simultaneously transported through melt transport to the same spinning assembly for parallel spinning. Wherein, the second esterification reactor was provided with three compartments. The high viscosity final polymerization reactor and the low viscosity final polymerization reactor both adopted a conventional structure in the prior art.

In particular, terephthalic acid, ethylene glycol and a catalyst ethylene glycol antimony were sequentially subjected to esterification reactions in the first esterification reactor and the second esterification reactor, and prepolymerization reactions in the first prepolymerization reactor and the second prepolymerization reactor to give an ethylene terephthalate prepolymer, and before the second esterification reaction in the second esterification reactor was carried out, an ordinary titanium dioxide matting agent color paste (prepared by grinding and dispersing titanium dioxide and ethylene glycol, with titanium dioxide accounting for 10 wt % and ethylene glycol accounting for 90 wt %) was added into one compartment of the second esterification reactor through corresponding pipelines. Wherein, the molar ratio of terephthalic acid to ethylene glycol was 1:1.25, and the usage amount of catalyst mentioned above was 210 ppm of antimony element in the total mass of the melt; the usage amount of matting agent was such that titanium dioxide accounted for 0.3% of the total mass of the melt. The ethylene terephthalate prepolymer was then introduced into the high viscosity final polymerization reactor and the low viscosity final polymerization reactor for polymerization, to give a high-viscosity PET melt and a low-viscosity PET melt; finally, the high-viscosity PET melt and the low-viscosity PET melt were directly introduced in a mass ratio of 5:5 to the same parallel composite spinning box for spinning, to obtain a PET two-component elastic fiber. Wherein, the parameters of the high-viscosity PBT melt and the low-viscosity PET melt are shown in Tables 3-5.

Comparative Example 2

This comparative example 2 provided a method for preparing a chip-spun high-viscosity PBT/low-viscosity PET two-component elastic fiber. In particular, a high-viscosity PBT melt chip and a low-viscosity PET melt chip were pre-crystallized and dry screw melted, the two melts were then directly introduced in a mass ratio of 5:5 to the same parallel composite spinning box for spinning, to obtain a chip-spun two-component elastic fiber. The properties of the corresponding chips are shown in Tables 3-5. Wherein, the high-viscosity PBT chip and the low-viscosity PET chip were both obtained commercially, and contained no titanium dioxide matting agents (matting agents cannot be added to the high-viscosity PBT chip).

Comparative Example 3

This comparative example 3 provided a method for preparing a chip-spun high-viscosity EDDP (disperse atmospheric metachromatic polyester)/low-viscosity PET two-component elastic fiber. In particular, a high-viscosity EDDP melt chip and a low-viscosity PET melt chip were pre-crystallized and dry screw melted, and the two melts were then directly introduced in a mass ratio of 5:5 to the same parallel composite spinning box for spinning, to obtain a chip-spun two-component elastic fiber. The properties of the corresponding chips are shown in Tables 3-5.

TABLE 1

Test indicators for esterification materials of high-viscosity PTT polyester

| PTT production line | Acid value (mg KOH/g) | | Agglomerated particles (5~10 μm)/mg | | Esterification rate | |
|---|---|---|---|---|---|---|
| | First esterification reactor | Second esterification reactor | First esterification reactor | Second esterification reactor | First esterification reactor | Second esterification reactor |
| Embodiment 1 | 39.52 | 14.96 | — | 0.02 | 92.8% | 97.3% |
| Embodiment 2 | 38.50 | 14.91 | — | 0.01 | 92.7% | 97.4% |
| Embodiment 3 | 37.54 | 13.95 | — | 0.03 | 93.2% | 97.7% |
| Embodiment 4 | 39.06 | 14.45 | — | 0.01 | 92.5% | 97.8% |
| Embodiment 5 | 39.55 | 14.95 | — | 0.00 | 92.6% | 98.1% |
| Embodiment 6 | 38.09 | 13.85 | — | 0.01 | 94.1% | 98.4% |
| Embodiment 7 | 38.60 | 13.87 | — | 0.03 | 93.7% | 98.9% |
| Embodiment 8 | 39.59 | 14.48 | — | 0.00 | 93.0% | 98.2% |
| Embodiment 9 | 38.10 | 14.56 | — | 0.02 | 94.3% | 98.4% |
| Embodiment 10 | 38.65 | 14.03 | — | 0.00 | 93.7% | 98.5% |
| Embodiment 11 | 38.58 | 13.65 | — | 0.02 | 93.9% | 98.6% |
| Embodiment 12 | 38.97 | 13.97 | — | 0.00 | 93.8% | 98.2% |
| Embodiment 13 | 39.25 | 14.05 | — | 0.03 | 92.9% | 98.0% |
| Embodiment 14 | 38.68 | 13.88 | — | 0.02 | 93.8% | 98.3% |
| Embodiment 15 | 39.54 | 14.22 | — | 0.00 | 92.7% | 97.8% |

TABLE 2

Test indicators for materials in the high-viscosity PTT second prepolymerization reactor

| | Prepolymer intrinsic viscosity (IV) | Agglomerated particles (5~10 μm)/mg |
|---|---|---|
| Embodiment 1 | 0.336 | 0.84 |
| Embodiment 2 | 0.337 | 0.66 |
| Embodiment 3 | 0.333 | 0.85 |
| Embodiment 4 | 0.340 | 0.59 |
| Embodiment 5 | 0.338 | 0.46 |
| Embodiment 6 | 0.336 | 0.61 |
| Embodiment 7 | 0.339 | 0.77 |
| Embodiment 8 | 0.341 | 0.08 |
| Embodiment 9 | 0.338 | 0.12 |
| Embodiment 10 | 0.338 | 0.02 |
| Embodiment 11 | 0.340 | 0.05 |
| Embodiment 12 | 0.337 | 0.04 |
| Embodiment 13 | 0.334 | 0.03 |
| Embodiment 14 | 0.340 | 0.06 |
| Embodiment 15 | 0.339 | 0.02 |

Note

The intrinsic viscosity was measured using a mixed solvent of phenol and tetrachloroethane (3:2).

TABLE 3

Test indicators for high-viscosity PTT polyester chips

| | Items | | | | | | | | | | |
|---|---|---|---|---|---|---|---|---|---|---|---|
| | Intrinsic | Titanium | Carboxyl terminal | Agglomerated particles | | | Melting | Hue | | | Ferrum |
| Unit | viscosity dl/g | dioxide % | group mol/t | ≤10 μm /mg | 5~10 μm /mg | Moisture % | point 0° C. | L value — | B value — | Ash % | content % |
| Embodiment 1 | 0.922 | 0.32 | 14.3 | 0.02 | 0.05 | 0.15 | 228.3 | 81.5 | 3.89 | 0.03 | — |
| Embodiment 2 | 0.921 | 0.33 | 13.9 | 0.00 | 0.02 | 0.13 | 228.3 | 81.8 | 4.15 | 0.03 | — |

TABLE 3-continued

Test indicators for high-viscosity PTT polyester chips

| Unit | Intrinsic viscosity dl/g | Titanium dioxide % | Carboxyl terminal group mol/t | Agglomerated particles ≤10 μm /mg | Agglomerated particles 5~10 μm /mg | Moisture % | Melting point 0° C. | Hue L value — | Hue B value — | Ash % | Ferrum content % |
|---|---|---|---|---|---|---|---|---|---|---|---|
| Embodiment 3 | 0.919 | 0.33 | 14.6 | 0.01 | 0.04 | 0.12 | 228.5 | 80.7 | 4.03 | 0.03 | — |
| Embodiment 4 | 0.923 | 0.33 | 13.8 | 0.03 | 0.06 | 0.15 | 228.2 | 80.9 | 3.66 | 0.02 | — |
| Embodiment 5 | 0.921 | 0.32 | 14.2 | 0.01 | 0.03 | 0.14 | 228.3 | 81.2 | 4.22 | 0.03 | — |
| Embodiment 6 | 0.919 | 0.32 | 14.5 | 0.00 | 0.04 | 0.16 | 228.5 | 81.5 | 3.75 | 0.02 | — |
| Embodiment 7 | 0.953 | 0.33 | 13.3 | 0.03 | 0.04 | 0.16 | 228.5 | 81.6 | 3.96 | 0.03 | — |
| Embodiment 8 | 0.982 | 0.33 | 11.2 | 0.04 | 0.05 | 0.17 | 228.3 | 80.9 | 4.28 | 0.02 | — |
| Embodiment 9 | 1.021 | 0.33 | 11.0 | 0.04 | 0.06 | 0.16 | 228.4 | 81.3 | 4.56 | 0.02 | — |
| Embodiment 10 | 1.050 | 0.32 | 10.7 | 0.03 | 0.03 | 0.13 | 228.5 | 80.8 | 4.69 | 0.02 | — |
| Embodiment 11 | 1.082 | 0.33 | 11.0 | 0.02 | 0.03 | 0.15 | 228.5 | 81.5 | 4.88 | 0.03 | — |
| Embodiment 12 | 1.101 | 0.33 | 10.7 | 0.03 | 0.05 | 0.13 | 228.3 | 80.5 | 5.15 | 0.02 | — |
| Embodiment 13 | 1.123 | 0.33 | 10.9 | 0.01 | 0.04 | 0.15 | 227.9 | 80.7 | 5.42 | 0.03 | — |
| Embodiment 14 (0.5% viscosity reducer added) | 1.022 | 0.32 | 11.2 | 0.00 | 0.02 | 0.15 | 228.4 | 81.1 | 4.52 | 0.03 | — |
| Embodiment 15 (0.8% viscosity reducer added) | 1.052 | 0.33 | 10.9 | 0.02 | 0.04 | 0.14 | 228.1 | 80.9 | 4.70 | 0.02 | — |
| Comparative example 1 (PET/PET) | 0.731 | 0.30 | 23.8 | 0.00 | 0.00 | 0.16 | 258.6 | 82.7 | 4.62 | 0.00 | — |
| Comparative example 2 (PBT/PET) | 1.122 | 0.00 | 15.6 | 0.04 | 0.06 | 0.12 | 224.8 | 88.4 | 6.05 | 0.04 | — |
| Comparative example 3 (EDDP/PET) | 0.803 | 0.30 | 22.7 | 0.00 | 0.01 | 0.25 | 246.5 | 80.6 | 6.27 | 0.01 | — |

Note:

The intrinsic viscosity was measured using a mixed solvent of phenol and tetrachloroethane (3:2); in Comparative example 1, the chip refers to the high-viscosity PET chip; in Comparative example 2, the chip refers to the high-viscosity PBT chip; in Comparative example 3, the chip refers to the high-viscosity EDDP chip.

TABLE 4

Physical and chemical indicators of low-viscosity PET polyester chips

| Unit | Intrinsic viscosity dl/g | Titanium dioxide % | Carboxyl terminal group mol/t | Agglomerated particles ≤10 μm /mg | Agglomerated particles 5~10 μm /mg | Moisture % | Melting point 0° C. | Hue L value — | Hue B value — | Ash % | Ferrum content % |
|---|---|---|---|---|---|---|---|---|---|---|---|
| Embodiment 1 | 0.452 | 0.30 | 28.3 | 0.00 | 0.00 | 0.18 | 259.2 | 84.3 | 2.89 | 0.00 | — |
| Embodiment 2 | 0.471 | 0.30 | 27.9 | 0.00 | 0.00 | 0.18 | 259.7 | 84.8 | 3.15 | 0.00 | — |
| Embodiment 3 | 0.492 | 0.30 | 27.6 | 0.00 | 0.00 | 0.16 | 258.5 | 83.7 | 3.03 | 0.01 | — |
| Embodiment 4 | 0.510 | 0.31 | 27.2 | 0.00 | 0.00 | 0.15 | 259.2 | 83.9 | 3.26 | 0.00 | — |
| Embodiment 5 | 0.532 | 0.30 | 27.8 | 0.00 | 0.00 | 0.19 | 259.4 | 84.0 | 3.24 | 0.00 | — |
| Embodiment 6 | 0.553 | 0.32 | 27.5 | 0.00 | 0.00 | 0.17 | 258.5 | 84.5 | 3.15 | 0.02 | — |
| Embodiment 7 | 0.550 | 0.30 | 27.3 | 0.00 | 0.00 | 0.16 | 258.3 | 83.8 | 3.51 | 0.00 | — |
| Embodiment 8 | 0.552 | 0.30 | 27.2 | 0.00 | 0.00 | 0.17 | 259.8 | 84.6 | 3.08 | 0.00 | — |
| Embodiment 9 | 0.550 | 0.30 | 27.5 | 0.00 | 0.00 | 0.18 | 259.4 | 84.3 | 3.03 | 0.00 | — |
| Embodiment 10 | 0.548 | 0.32 | 27.2 | 0.00 | 0.00 | 0.18 | 258.8 | 84.1 | 3.29 | 0.01 | — |
| Embodiment 11 | 0.552 | 0.30 | 29.0 | 0.00 | 0.00 | 0.15 | 259.2 | 84.5 | 3.05 | 0.00 | — |
| Embodiment 12 | 0.549 | 0.31 | 28.2 | 0.00 | 0.00 | 0.19 | 259.6 | 83.7 | 2.89 | 0.00 | — |
| Embodiment 13 | 0.553 | 0.30 | 27.3 | 0.00 | 0.00 | 0.17 | 258.9 | 84.3 | 3.07 | 0.00 | — |
| Embodiment 14 (0.5% viscosity reducer added) | 0.550 | 0.30 | 27.8 | 0.00 | 0.00 | 0.18 | 259.7 | 84.1 | 3.15 | 0.02 | — |
| Embodiment 15 (0.8% viscosity reducer added) | 0.551 | 0.30 | 27.6 | 0.00 | 0.00 | 0.18 | 259.1 | 83.5 | 2.94 | 0.00 | — |
| Comparative example 1 | 0.473 | 0.30 | 28.2 | 0.00 | 0.00 | 0.16 | 259.5 | 84.8 | 2.99 | 0.00 | — |
| Comparative example 2 | 0.471 | 0.30 | 28.3 | 0.00 | 0.00 | 0.18 | 259.3 | 84.2 | 3.24 | 0.01 | — |

TABLE 4-continued

| Physical and chemical indicators of low-viscosity PET polyester chips | | | | | | | | | | | |
|---|---|---|---|---|---|---|---|---|---|---|---|
| | Items | | | | | | | | | | |
| | Intrinsic | Titanium | Carboxyl terminal | Agglomerated particles | | | Melting | Hue | | | Ferrum |
| Unit | viscosity dl/g | dioxide % | group mol/t | ≤10 μm /mg | 5~10 μm /mg | Moisture % | point 0° C. | L value — | B value — | Ash % | content % |
| Comparative example 3 | 0.473 | 0.31 | 29.0 | 0.00 | 0.00 | 0.16 | 259.7 | 84.5 | 3.18 | 0.00 | — |

Note:
The intrinsic viscosity was measured using a mixed solvent of phenol and tetrachloroethane (3:2).

TABLE 5

| Control data of high-viscosity PTT polymerization reactor and related indicators of high-viscosity PTT and low-viscosity PET | | | | | | | | |
|---|---|---|---|---|---|---|---|---|
| No. | Vacuum degree in polymerization reactor/Pa | Temperature at low viscosity PTT melt inlet/° C. | Agitating rate in low viscosity zone/rpm | Temperature at high-viscosity melt outlet/° C. | Agitating rate in med-high viscosity and high viscosity zones/rpm | Intrinsic viscosity at high viscosity PTT melt outlet | Viscosity of low viscosity PET melt | Viscosity difference between high viscosity PTT melt and low viscosity PET melt |
| Embodiment 1 | 138.0 | 250.4 | 4.2 | 252.6 | 2.35 | 0.922 | 0.452 | 0.470 |
| Embodiment 2 | 136.6 | 250.2 | 4.2 | 252.4 | 2.35 | 0.921 | 0.471 | 0.450 |
| Embodiment 3 | 139.3 | 250.2 | 4.2 | 252.3 | 2.35 | 0.919 | 0.492 | 0.427 |
| Embodiment 4 | 135.6 | 250.0 | 4.2 | 252.5 | 2.35 | 0.923 | 0.510 | 0.413 |
| Embodiment 5 | 139.8 | 250.7 | 4.2 | 252.3 | 2.35 | 0.921 | 0.532 | 0.389 |
| Embodiment 6 | 137.5 | 250.8 | 4.2 | 252.3 | 2.35 | 0.919 | 0.553 | 0.366 |
| Embodiment 7 | 132.7 | 250.2 | 4.4 | 252.6 | 2.42 | 0.953 | 0.550 | 0.403 |
| Embodiment 8 | 129.2 | 250.0 | 4.4 | 252.8 | 2.42 | 0.982 | 0.552 | 0.430 |
| Embodiment 9 | 126.8 | 250.3 | 4.5 | 252.7 | 2.45 | 1.021 | 0.550 | 0.470 |
| Embodiment 10 | 120.5 | 250.2 | 4.6 | 252.9 | 2.45 | 1.050 | 0.548 | 0.502 |
| Embodiment 11 | 117.6 | 250.5 | 4.6 | 252.7 | 2.48 | 1.082 | 0.552 | 0.530 |
| Embodiment 12 | 115.2 | 250.3 | 4.8 | 252.8 | 2.48 | 1.101 | 0.549 | 0.552 |
| Embodiment 13 | 112.8 | 250.0 | 4.8 | 252.8 | 2.48 | 1.123 | 0.553 | 0.570 |
| Embodiment 14 | 127.3 | 250.3 | 4.5 | 252.6 | 2.45 | 1.022 | 0.550 | 0.472 |
| Embodiment 15 | 122.5 | 250.1 | 4.6 | 252.7 | 2.45 | 1.052 | 0.551 | 0.501 |
| Comparative example 1 | 158.5 | 279.3 | 5.2 | 284.5 | 2.78 | 0.731 | 0.473 | 0.258 |
| Comparative example 2 (purchased chip) | Not involved | Not involved | Not involved | Not involved | Not involved | 1.122 | 0.471 | 0.651 |
| Comparative example 3 | Not involved | Not involved | Not involved | Not involved | Not involved | 0.803 | 0.473 | 0.330 |

The properties of the composite elastic fibers obtained by spinning the high-viscosity melt and the low-viscosity PET melt corresponding to Embodiments 1-15 and Comparative Examples 1-3 are shown in Table 6, where the fiber variety is FDY and the specification is 83 dtex/36f. The fiber properties in the present disclosure were tested according to GBT 8960-2015 testing standard.

TABLE 6

| Physical and chemical indicators of PTT/PET two-component composite elastic fibers | | | | | | | | | |
|---|---|---|---|---|---|---|---|---|---|
| No. | Specification | Denier count/ dtex | Strength/ cN/dtex | Elongation/ % | Oil content/ % | Yarn evenness CV/% | Boiling water shrinkage rate/% | Crimp shrinkage rate/% | Interlacing point |
| Embodiment 1 | 83/36 | 83.2 | 2.84 | 30.74 | 1.45 | 1.34 | 18.42 | 51.5 | 4 |
| Embodiment 2 | 83/36 | 82.6 | 2.82 | 31.10 | 1.47 | 1.36 | 18.35 | 49.6 | 4 |
| Embodiment 3 | 83/36 | 83.4 | 2.82 | 31.51 | 1.51 | 1.35 | 18.28 | 48.1 | 4 |
| Embodiment 4 | 83/36 | 82.7 | 2.85 | 30.18 | 1.44 | 1.38 | 18.24 | 46.2 | 4 |
| Embodiment 5 | 83/36 | 82.9 | 2.83 | 30.63 | 1.49 | 1.33 | 18.14 | 41.8 | 4 |

TABLE 6-continued

Physical and chemical indicators of PTT/PET two-component composite elastic fibers

| No. | Specification | Denier count/ dtex | Strength/ cN/dtex | Elongation/ % | Oil content/ % | Yarn evenness CV/% | Boiling water shrinkage rate/% | Crimp shrinkage rate/% | Interlacing point |
|---|---|---|---|---|---|---|---|---|---|
| Embodiment 6 | 83/36 | 82.6 | 2.84 | 31.90 | 1.43 | 1.35 | 18.11 | 38.4 | 4 |
| Embodiment 7 | 83/36 | 83.5 | 2.90 | 31.32 | 1.48 | 1.34 | 18.24 | 45.6 | 4 |
| Embodiment 8 | 83/36 | 82.9 | 2.92 | 30.16 | 1.53 | 1.37 | 18.15 | 47.3 | 4 |
| Embodiment 9 | 83/36 | 83.1 | 2.95 | 30.77 | 1.44 | 1.28 | 18.03 | 51.7 | 4 |
| Embodiment 10 | 83/36 | 83.3 | 2.93 | 30.55 | 1.46 | 1.35 | 17.96 | 56.4 | 5 |
| Embodiment 11 | 83/36 | 83.5 | 2.98 | 30.42 | 1.45 | 1.29 | 18.21 | 59.8 | 4 |
| Embodiment 12 | 83/36 | 82.8 | 3.05 | 30.03 | 1.45 | 1.34 | 18.08 | 62.6 | 4 |
| Embodiment 13 | 83/36 | 83.6 | 3.22 | 29.89 | 1.42 | 1.37 | 17.97 | 65.3 | 5 |
| Embodiment 14 | 83/36 | 83.2 | 2.92 | 30.52 | 1.47 | 1.35 | 18.12 | 62.7 | 4 |
| Embodiment 15 | 83/36 | 83.4 | 2.96 | 30.39 | 1.44 | 1.33 | 18.03 | 63.9 | 4 |
| Comparative example 1 (PET/PET) | 83/36 | 82.9 | 2.89 | 26.88 | 1.32 | 1.19 | 13.52 | 26.5 | 4 |
| Comparative example 2 (PBT/PET) | 83/36 | 82.7 | 2.72 | 33.39 | 1.57 | 1.34 | 15.20 | 37.2 | 4 |
| Comparative example 3 (EDDP/PET) | 83/36 | 83.1 | 2.68 | 29.55 | 1.40 | 1.42 | 16.54 | 30.3 | 4 |

It can be seen that the present disclosure utilizes two different polyester production lines to produce a high-viscosity PTT polyester and a low-viscosity PET polyester, respectively, the two melts of different viscosities are then transported to the same parallel composite spinning assembly through melt transport, after which the high-viscosity PTT/low-viscosity PET two-component elastic fiber is prepared, achieving the preparation of direct melt-spun high-viscosity PTT/low-viscosity PET parallel elastic fiber, the obtained fiber has excellent performance.

The embodiments described above are only for illustrating the technical concepts and features of the present disclosure, and are intended to make a person familiar with the technology being able to understand the content of the present disclosure and thereby implement it, and should not limit the protective scope of this disclosure. Any equivalent variations or modifications according to the spirit of the present disclosure should be covered by the protective scope of the present disclosure.

What is claimed is:

1. A high-viscosity PTT polymerization reactor, used to prepare a high-viscosity PTT melt for preparing a high-viscosity PTT/low-viscosity PET two-component elastic fiber, wherein, the high-viscosity PTT polymerization reactor is a horizontal polymerization reactor, and comprises a main body containing a chamber internally, the main body comprises a low viscosity zone, a med-high viscosity zone and a high viscosity zone disposed in sequence along the axial direction of the high-viscosity PTT polymerization reactor, the viscosity of the PTT melt in the low viscosity zone, the med-high viscosity zone and the high viscosity zone increases in sequence; the low viscosity zone and the med-high viscosity zone are both provided with disc reactors combinations, and the high viscosity zone is provided with a plurality of single-disc reactors; the high-viscosity PTT polymerization reactor further comprises a rotating shaft disposed in the front end of the low viscosity zone, a cage disc reactor combinations is designed in the low viscosity zone of the high-viscosity PTT polymerization reactor, and comprises a plurality of disc reactors combinations, and an outer cage frame fixedly connected to outer edges of the disc reactors combinations, and the rotating shaft drives the outer cage frame and the plurality of disc reactors combinations in the low viscosity zone to rotate; there is no agitating shaft disposed in an axial region corresponding to the disc reactors combinations in the low viscosity zone, and a circular channel is designed in the middle portion of the disc reactors combinations; there is an agitating shaft disposed in both the med-high viscosity zone and the high viscosity zone, and the disc reactors in the med-high viscosity zone and the high viscosity zone pass through the agitating shaft; the outer cage frame comprises a cage shaped part with a gear shaped in front end, and a material propelling part extending along the axial direction of the high-viscosity PTT polymerization reactor from each gear bend of the cage shaped part, and the outer cage frame is fixedly connected to the rotating shaft.

2. The high-viscosity PTT polymerization reactor according to claim 1, wherein, the length of the low viscosity zone is half of the length of the high-viscosity PTT polymerization reactor, and the total length of the med-high viscosity zone and the high viscosity zone is half of the length of the high-viscosity PTT polymerization reactor.

3. The high-viscosity PTT polymerization reactor according to claim 1, wherein, the length of the agitating shaft disposed in the med-high viscosity zone and the high viscosity zone is half of the length of the high-viscosity PTT polymerization reactor.

4. The high-viscosity PTT polymerization reactor according to claim 1, wherein, the high-viscosity PTT polymerization reactor further comprises a prepolymer inlet located at the bottom of the front end of the low viscosity zone and a high-viscosity PTT melt outlet located at the bottom of the rear end of the high viscosity zone, wherein the high-viscosity PTT melt outlet is trumpet-shaped.

5. The high-viscosity PTT polymerization reactor according to claim 4, wherein, the cross-section of the material propelling part is in a wedge shape, and the thick end of the wedge is oriented towards the direction of rotation of the disc reactors; and/or, there are 8-12 material propelling parts.

6. The high-viscosity PTT polymerization reactor according to claim 1, wherein, the disc reactors in the med-high viscosity zone have a plurality of disc combinations, namely a 4-disc combination, a 3-disc combination and a 2-disc combination in sequence from front to rear; in the 2-disc combinations in the med-high viscosity zone, the distances between the disc combinations and between their two discs in each combination increases from front to rear; the total number of disc reactors in the med-high viscosity zone and the high viscosity zone is 25-35; there are 8-12 single-disc reactors in the high viscosity zone, with the diameter of the disc reactors decreasing from front to rear, and the diameter of the last disc reactor is 88%-92% of the diameter of the first disc reactor in the high viscosity zone; the high viscosity zone is further provided with a composite scraper, which comprises an axial scraper for scraping off the melt on the agitating shaft, a wall scraper for scraping off the melt on the inner wall of the high-viscosity PTT polymerization reactor, and a disc scraper for scraping off the melt on the disc reactors, the disc scraper being arranged in two layers and controlling the thickness of material on the disc reactors to not exceed 30 mm.

7. A method for preparing a high-viscosity PTT/low-viscosity PET two-component elastic fiber, the two-component elastic fiber containing a high-viscosity PTT component and a low-viscosity PET component, the viscosity of the high-viscosity PTT component being greater than that of the low-viscosity PET component, wherein, the preparation method comprises steps of preparing a high-viscosity PTT melt and a low-viscosity PET melt separately, and spinning the high-viscosity PTT melt and the low-viscosity PET melt through the same parallel composite spinning assembly to obtain the two-component elastic fiber; the viscosity of the high-viscosity PTT melt is greater than the viscosity of the low-viscosity PET melt; the step of preparing a high-viscosity PTT melt comprises sequentially passing terephthalic acid and 1,3-propanediol through a first esterification reactor and a second esterification reactor for esterification reactions, through a first prepolymerization reactor and a second prepolymerization reactor for prepolymerization reactions to give a PTT prepolymer, and polymerizing the PTT prepolymer in the high-viscosity PTT polymerization reactor to obtain the high-viscosity PTT melt, the high-viscosity PTT polymerization reactor is the high-viscosity PTT polymerization reactor according to claim 1; the step of preparing low-viscosity PET melt comprises sequentially passing terephthalic acid and ethylene glycol through a first esterification reactor and a second esterification reactor for esterification reactions, through a first prepolymerization reactor and a second prepolymerization reactor for prepolymerization reactions to give a PET prepolymer, and polymerizing the PET prepolymer in a low-viscosity PET final polymerization reactor to obtain the low-viscosity PET melt.

8. The preparation method according to claim 7, wherein, in percent by weight, the two-component elastic fiber contains 35%-65% of high-viscosity PTT component and 65%-35% of low-viscosity PET component; and/or, the high-viscosity PTT melt has an intrinsic viscosity of 0.92-1.16, and a dynamic viscosity of 320-1200 Pa·s; the low-viscosity PET melt has an intrinsic viscosity of 0.45-0.55, and a dynamic viscosity of 90-240 Pa·s.

9. The preparation method according to claim 7, wherein, in the same parallel composite spinning assembly, the high-viscosity PTT melt has a dynamic viscosity of 350-800 Pa·s, and the low-viscosity PET melt has a dynamic viscosity of 70-220 Pa·s.

10. The preparation method according to claim 7, wherein, the preparation method controls the rotation rate of the rotating shaft in the low viscosity zone to be 0-5.5 rpm; and/or, the preparation method controls the agitation rate of the agitating shaft in the med-high viscosity zone and the high viscosity zone to be 0-3.0 rpm.

11. The preparation method according to claim 7, wherein, the PTT prepolymer introduced into the high-viscosity PTT polymerization reactor has an intrinsic viscosity of 0.280-0.350.

12. The preparation method according to claim 7, wherein, when preparing the high-viscosity PTT melt, the preparation method further comprises a step of adding an esterification catalyst to the first esterification reactor before carrying out the esterification reaction, wherein the esterification catalyst is selected from tetrabutyl titanate and tetraisopropyl titanate.

13. The preparation method according to claim 12, wherein, the second esterification reactor used for preparing the high-viscosity PTT melt is a horizontal reactor, and comprises three compartments arranged in sequence from front to rear, and when preparing the high-viscosity PTT melt, the preparation method further comprises a step of adding a catalyst blocking agent to the second compartment from front to rear of the second esterification reactor after the esterification reaction in the first compartment from front to rear of the second esterification reactor has completed, to deactivate the esterification catalyst, where the catalyst blocking agent is selected from trimethyl phosphate and phosphoric acid, and the mass of the catalyst blocking agent accounts for 15-30 ppm of the mass of the high-viscosity PTT melt.

14. The preparation method according to claim 13, wherein, when preparing the high-viscosity PTT melt, the preparation method further comprises a step of adding a polymerization catalyst to the third compartment from front to rear of the second esterification reactor; the polymerization catalyst is prepared by reacting a titanate with a protonic acid under anhydrous conditions, removing alcohol by-products, and dissolving the reaction system in 1,3-propanediol.

15. The preparation method according to claim 14, wherein, the titanate is selected from the group consisting of tetrabutyl titanate, tetraisopropyl titanate, and tetra(2-ethylhexyloxy) titanate; and/or, the protonic acid is selected from the group consisting of formic acid, acetic acid, propionic acid, oxalic acid, malonic acid, succinic acid, citric acid, tripolyphosphoric acid, polyphosphoric acid, and combinations thereof; and/or, the mass ratio of the titanate to the protonic acid is 1:(0.5-2.0); and/or, in the polymerization catalyst, the mass percentage of titanium element is 1.0%-3.0%.

16. The preparation method according to claim 14, wherein, the mass of titanium element in the esterification catalyst accounts for 1-30 ppm of the mass of the high-viscosity PTT melt; and/or, the mass of titanium element in the polymerization catalyst accounts for 30-100 ppm of the mass of the high-viscosity PTT melt.

17. The preparation method according to claim 7, wherein, the low-viscosity PET final polymerization reactor is a horizontal polymerization reactor, and the length-to-diameter ratio thereof is (2.2-2.8):1.0.

18. The preparation method according to claim 7, wherein, when preparing the high-viscosity PTT melt, the molar ratio of terephthalic acid to 1,3-propanediol is 1:(1.05-1.65); and/or, the esterification reaction in the first esterification reactor used for preparing the high-viscosity PTT melt is carried out at 250° C.-252° C.; and/or, the esterification reaction in the first esterification reactor used for preparing the high-viscosity PTT melt is carried out at a pressure of 0.7-1.8 $kgf/cm^2$.

* * * * *